United States Patent [19]

Moser et al.

[11] 3,948,493

[45] Apr. 6, 1976

[54] PROCESS FOR CONVEYING A DEVELOPER MIXTURE

[75] Inventors: Hermann Moser, Darmstadt; Wolfram Saupe, Mammolshain, both of Germany

[73] Assignee: Hoechst Aktiengesellschaft, Frankfurt, Germany

[22] Filed: June 27, 1973

[21] Appl. No.: 374,076

[30] Foreign Application Priority Data

June 30, 1972 Germany ..... 2232010

[52] U.S. Cl. ..... 259/99; 355/3 DD; 198/198

[51] Int. Cl.[2] ..... B01F 7/04

[58] Field of Search ..... 259/102, 99, 103, 114; 355/3 DD, 10; 118/637; 198/198, 199, 201

[56] References Cited

UNITED STATES PATENTS

| | | | |
|---|---|---|---|
| 852,325 | 4/1907 | Hall | 259/114 |
| 2,832,311 | 4/1958 | Byrne | 355/3 DD |
| 2,874,824 | 2/1959 | Sund | 198/198 |
| 3,245,518 | 4/1966 | Reidel | 198/198 |
| 3,472,657 | 10/1969 | Mayer | 355/3 DD |
| 3,754,962 | 8/1973 | Berlier | 355/3 DD |

*Primary Examiner*—Robert W. Jenkins
*Attorney, Agent, or Firm*—Stevens, Davis, Miller & Mosher

[57] ABSTRACT

A process for mixing enriched dry developer with depleted dry developer in an electrophotographic copying system which includes the steps of conveying a dry developer mixture from a reservoir to a developing station, returning a substantial portion of the developer mixture removed from the reservoir to the reservoir before it reaches the developing zone and mixing it with depleted developer mixture from the developing station. An apparatus for accomplishing the process including at least one endless conveyor belt on which plates are positioned at intervals along its length projecting outwardly and mounted at right angles to the center line thereof and at least one pair of rollers upon which the belt is mounted. This apparatus also may include a cover plate for a portion of the belt. The belt may have internal serrations and be composed of soft elastic material.

7 Claims, 8 Drawing Figures

PROCESS FOR CONVEYING A DEVELOPER MIXTURE

Figure 1:
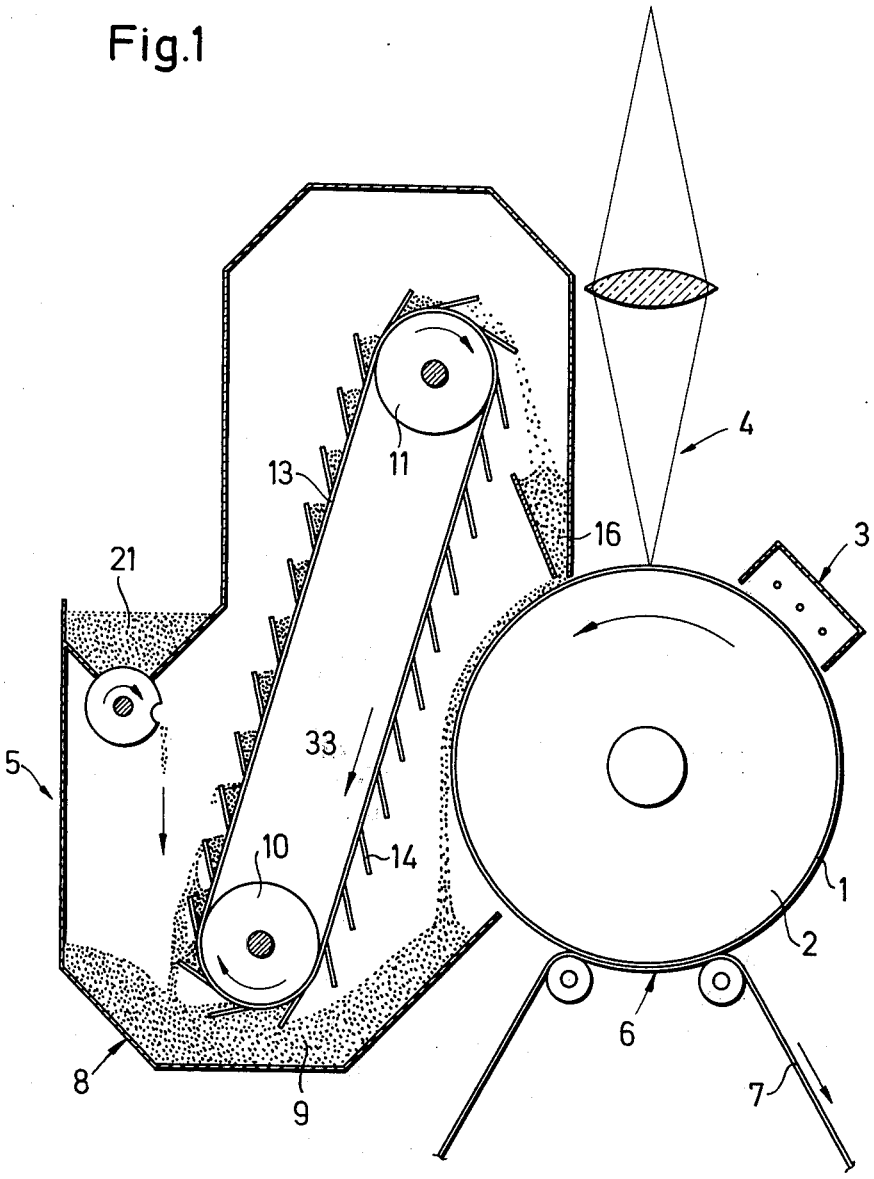

The present invention relates to a process for conveying and mixing a developer mixture in which the mixture is conveyed from a stock upwards to a point of release.

In developing devices of electrophotographic copying instruments a mixture comprising a carrier and a toner is often fed from a reservoir into, for example, a feed hopper from which the developer mixture trickles over a charged layer which has been exposed to form a latent image, to develop the latent charge image. So-called bucket conveyors are now often used for conveying the mixture, these conveyors posessing essentially elongate trough-like buckets closed at their ends, which are fixed to endless belts or chains and circulated in order to convey the developer mixture to the hopper.

In these processes, each bucket fills completely on immersion in the developer stock, pushes its way through the remaining amount of the developer stock substantially without mixing its contents with it and, after leaving the stock, carries the contents to the point where they are released. The conveyed developer mixture thus essentially executes a closed path. The topping-up of the component of the developer mixture which is consumed during the developing process presents major difficulties especially in the case of high-speed electrophotographic instruments. To obtain uniform copies, especially copies of approximately constant blackness, fresh toner must be added at least periodically to the developer mixture. In order to improve the uniformity of the copy quality it already has been proposed to supply the toner at the point at which the developer mixture flows back into the stock after having been used. However, this method leads to a situation where the buckets convey, in alternation, developer mixture which is greatly depleted in toner and mixture which is disproportionately enriched in toner.

A further disadvantage of the presently used methods is that the buckets are fixed to metal chains driven by sprockets. In addition to generating considerable noise, this is likely to damage the developer mixture because the granular constituent (the carrier) is ground between the chains and the sprockets. In addition, this type of bucket conveyor is relatively complex and expensive to make.

The present invention provides a process for conveying a developer mixture from a reservoir to a developing station in which a substantial portion of the developer mixture removed by a conveyor from the reservoir is returned to the reservoir without reaching the developing station and is mixed with developer returning from the developing station.

Advantageously, a considerable part of the developer mixture, before reaching a release point for the developing station, is returned to the reservoir on the side of the conveyor on which the conveyed mixture leaves the reservoir and the returned developer mixture and the developer mixture which falls down from the developing station after having been used for developing are combined in the reservoir optionally with additional mixing.

Preferably, a conveyor belt of flexible elastic material is used.

A defined percentage, preferably, at least 10% of the developer removed from the reservoir is returned. If desired, the process can be regarded as one in which two closed streams of developer are produced, which are similar in form to adjacent fluid vortices. One stream of developer mixture goes via the conveyor, the release point and the developing station back to the reservoir. The other stream goes via the conveyor directly back to the point at which the developer mixture is removed from the reservoir by the conveyor. When the process has settled down to an equilibrium, the conveyor conveys the quantity of developer mixture that corresponds to the two streams. In the area of the developer reservoir, considerable mixing of the two streams results. As a consequence, the developer mixture which has been depleted in toner by the developing process is constantly mixed with the developer mixture of higher toner concentration. It is advantageous, to add to the returning or returned part of the developer mixture a topping-up supply of the component of the mixture which has been taken out by the developing process (the toner). Hence, mixing with the newly supplied toner is achieved in the return stream of developer mixture. This stream containing enriched developer mixture is then mixed with the stream of depleted developer mixture so that a very uniform toner concentration is achieved.

The present invention also provides an apparatus for carrying out the process which comprises an endless belt on which several plates are positioned at intervals along the length of the belt, the plates being mounted transverse to the length of the belt, and projecting outwardly at an appropriate angle from the plane of the belt.

Preferably, the plates and the belt are made in one piece, of a soft flexible elastic material, for example a plastic, to reduce noise and grinding of the carrier. Any undesired stretching of the belt can be prevented by steel cord reinforcement. The inclination of the belt and the direction of the plates relative to the belt are so chosen that a certain amount of developer is lifted by each plate from the stock into which the circulating belt dips but that a considerable part of the developer mixture trickles over the free edge of the plate directly back into the stock and only the residue which remains reaches the release point and hence comes to be utilized in the developing station.

If desired, the device according to the present invention can also possess a further, preferably similar, belt with projecting plates, with the projections of the two belts intermeshing like the teeth of the two combs. In this case, the projections of the second belt are at such an angle that they take back with them, into the reservoir, a considerable part of the developer mixture which is conveyed in the zone in which the projections of the two belts intermesh. The two vortex-like tracks of stream of developer can be thought of in this case as being represented by the two circulating belts. However, it is to be brone in mind that the two streams of developer leave the belts for a certain part of their circulation track, in that they fall down from the belts. This occurs, for the stream of developer which is used for the actual developing, at the release point for the developing station and, for the return stream, at the point at which the static friction between the developer mixture and the rear of the projections is no longer sufficient to hold the developer mixture.

If desired, a fixed cover can be provided which is located in the immediate vicinity of the free edges of the plates remote from the belt, with the result that the stream of developer mixture which is returned directly to the reservoir executes a defined circulation without premature mixing occurring in the covered zone of the conveyor buckets formed by the plates and the belt.

By suitably choosing the size of the reservoir in the zone into which the returning stream of developer flows it is possible to achieve relatively rapid circulation of the returned developer mixture and hence the toner concentration in the developer mixture can be controlled simply and rapidly.

Figure 2:
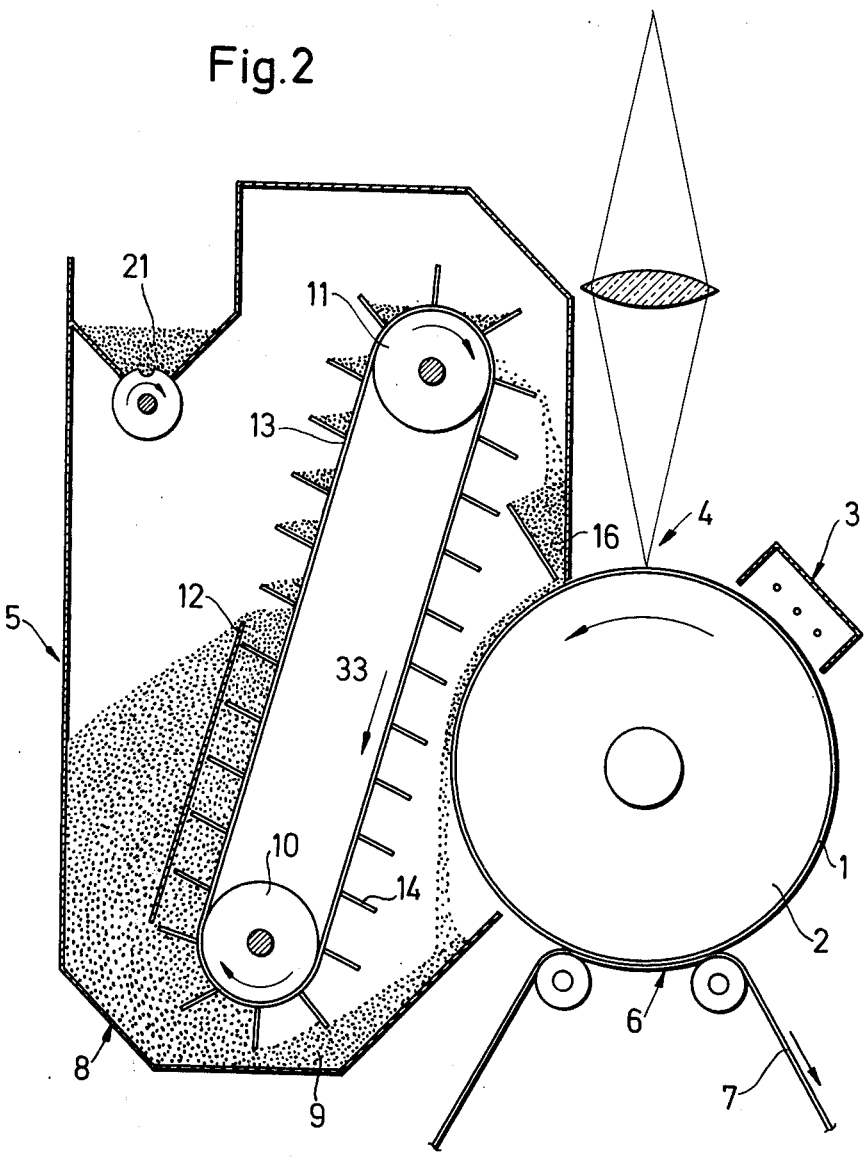
Figure 3:
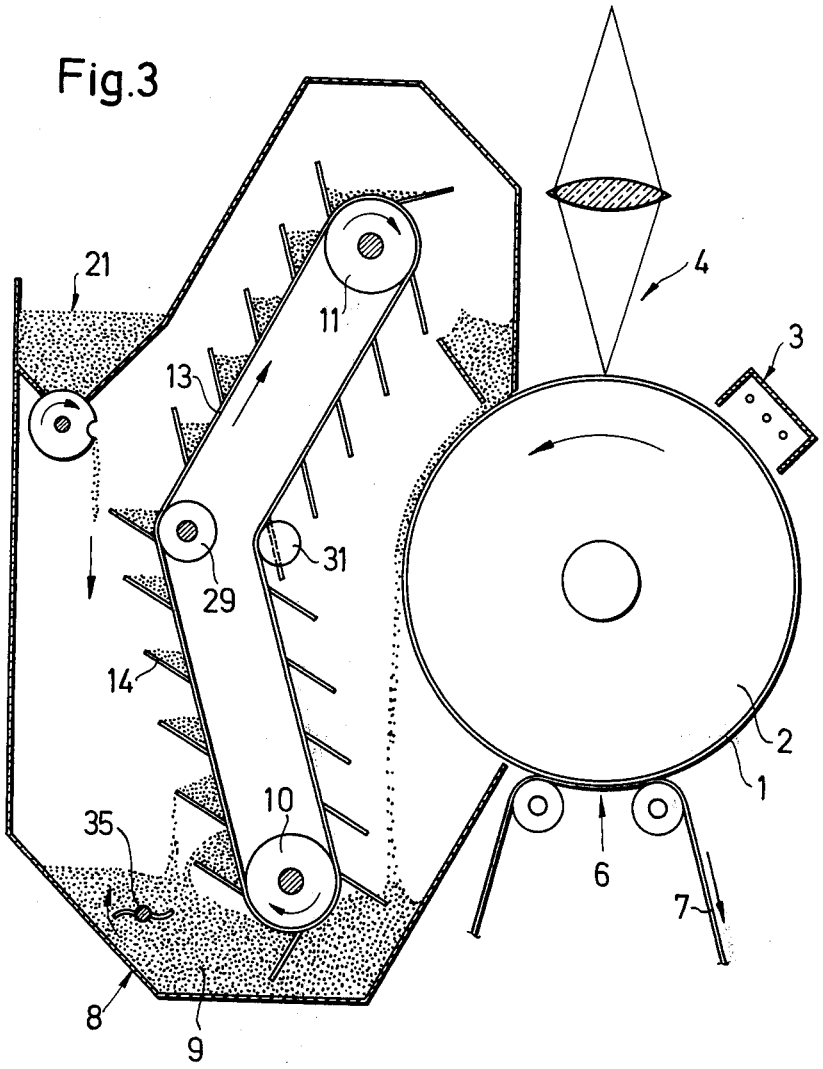
Figure 4:
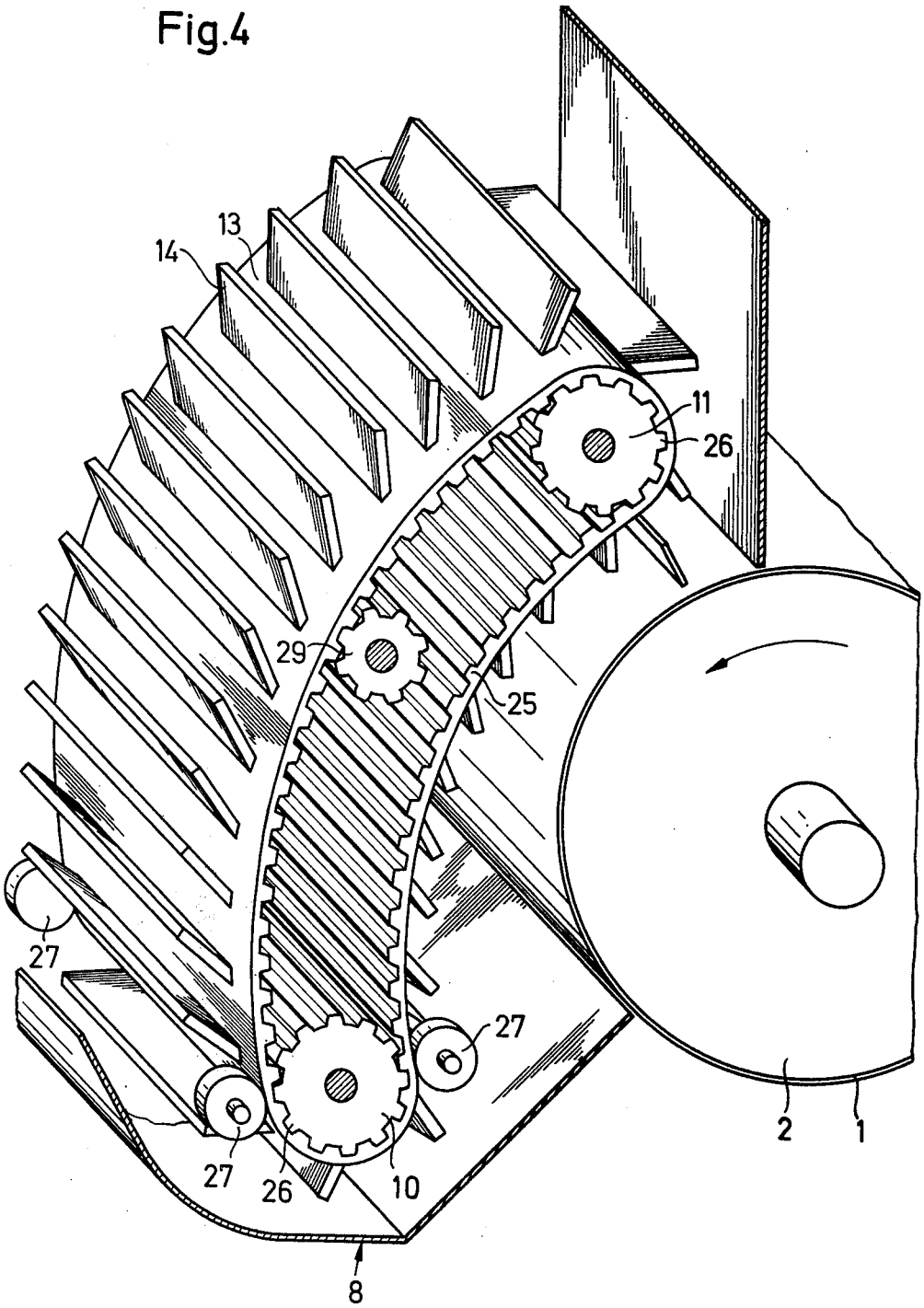
Figure 5:
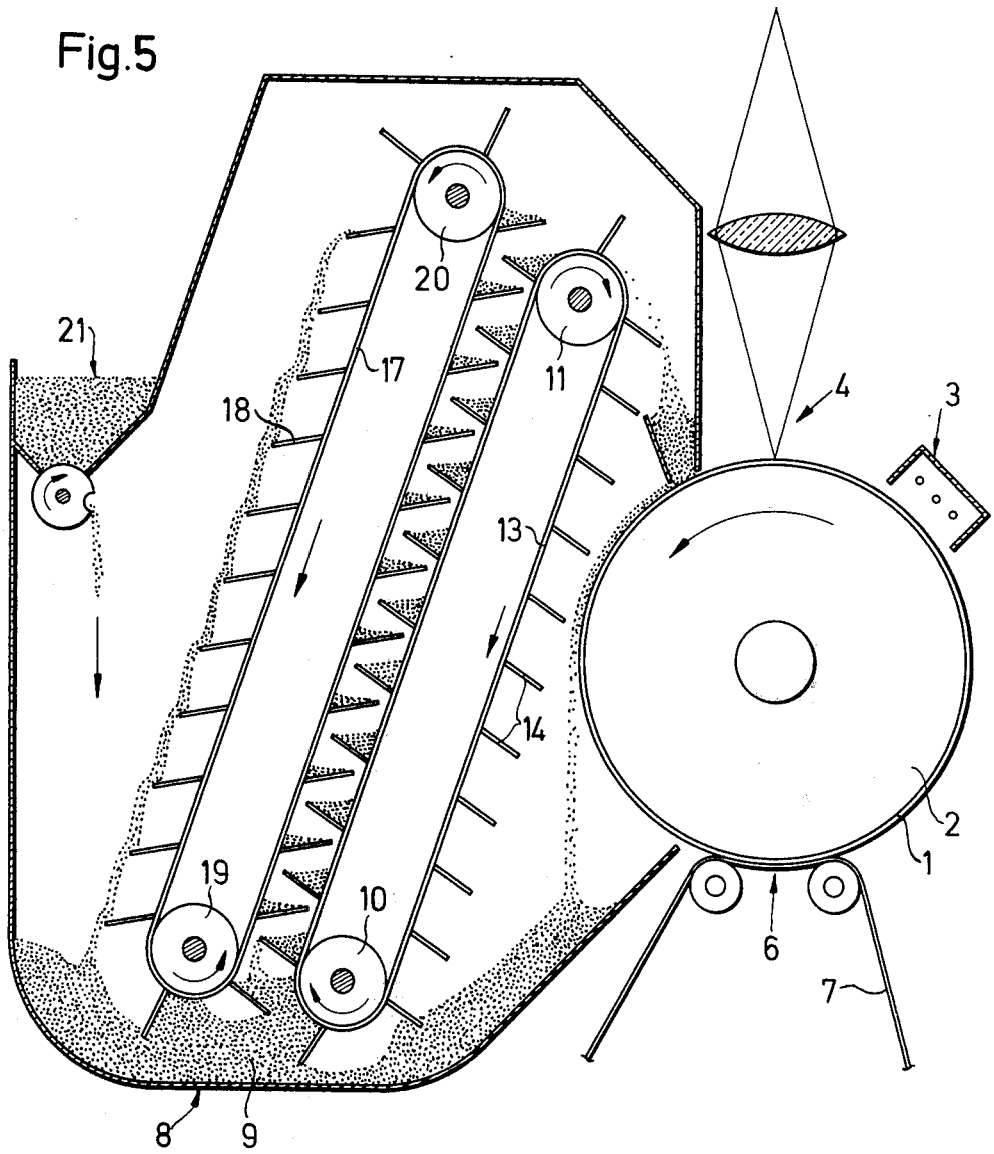
Figure 6:
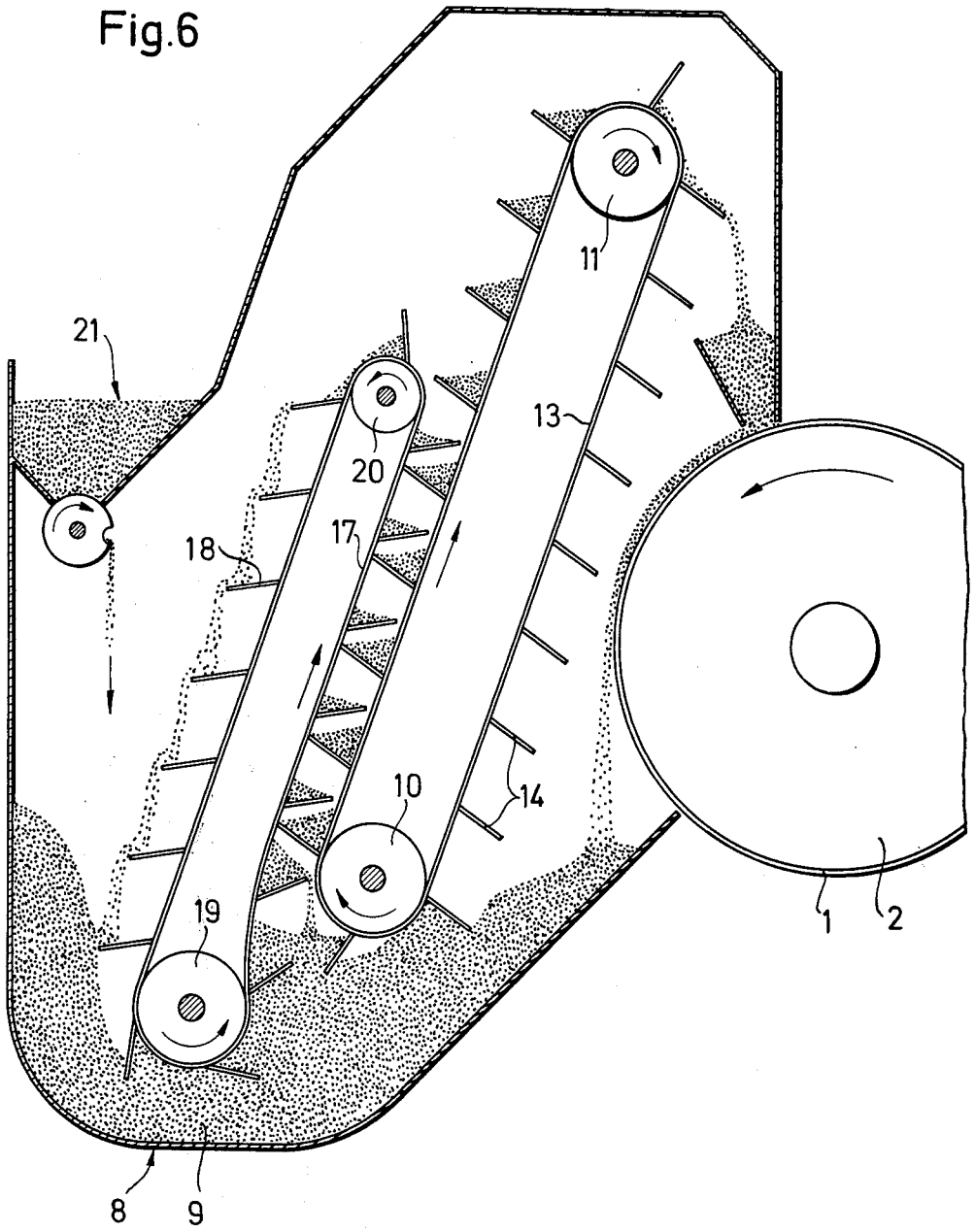

The process and device of the present invention will now be described by way of example only, with reference to the accompanying drawings, in which FIG. 1 shows a schematic cross-section of part of an electrophotographic copying device with a conveyor constructed in accordance with the present invention, FIG. 2 shows a cross-section similar to FIG. 1, with a modified conveyor, FIG. 3 shows a schematic cross-section through a conveyor in which the path of the belt is angled, FIG. 4 shows a perspective view of a conveyor in which the path of the belt is curved, FIG. 5 shows a schematic cross-sectional representation through a conveying device with two belts, FIG. 6 shows a schematic cross-sectional representation through a second conveying device with two belts.

Figure 8:
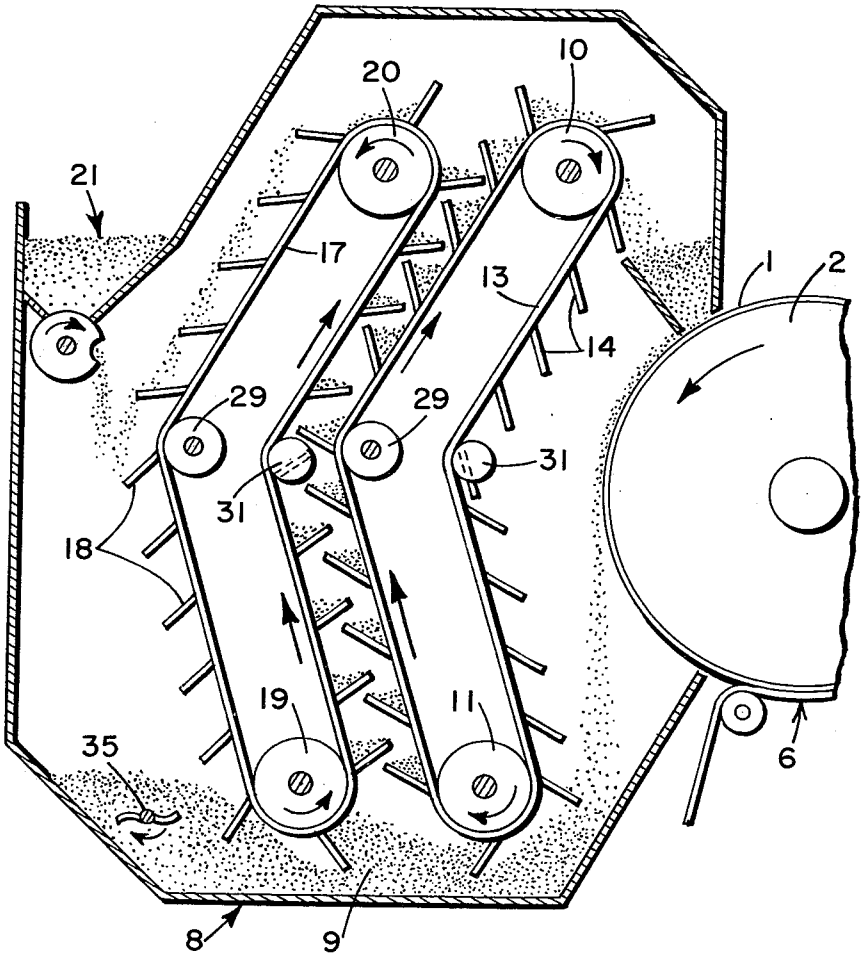
Figure 7:
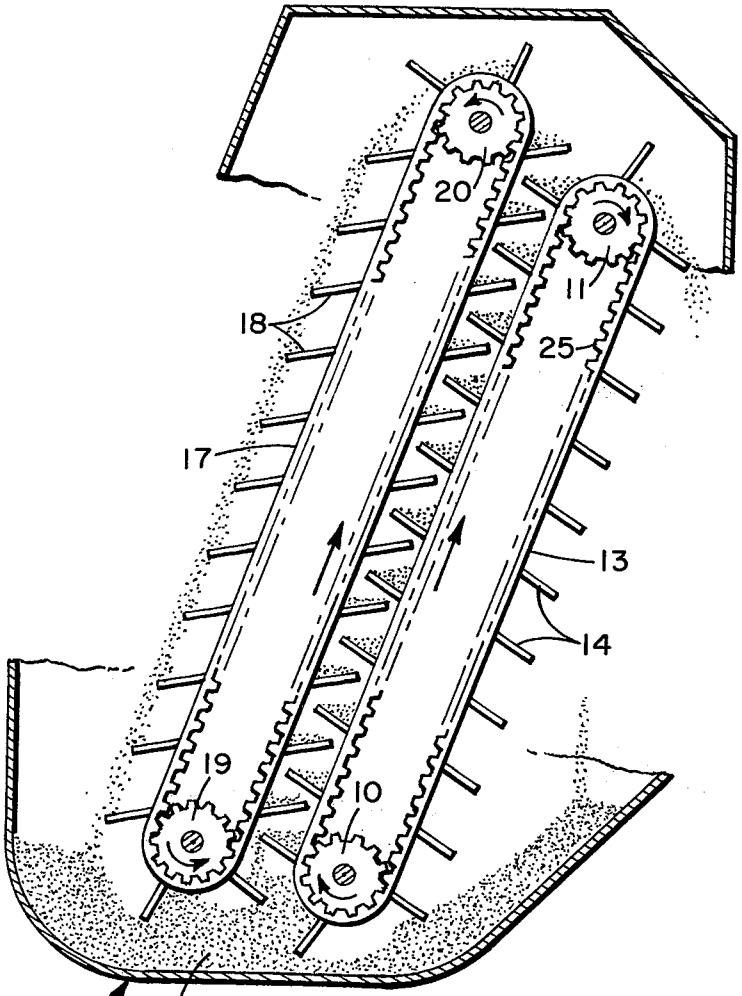

FIG. 7 shows a schematic cross-section through a conveying device in which each belt has internal serrations and is driven by toothed rollers, and FIG. 8 shows a schematic cross-section through a conveying device in which the path of each belt is angled.

Referring now to the drawings, a photoconductor 1, coated on a drum 2, is uniformly charged electrostatically with the aid of a corona discharge station 3. The charged photoconductor is exposed in an exposure station 4 and as a result a charge pattern corresponding to an original is formed on the photoconductor 1. Thereafter, the charge pattern on the photoconductor is developed, for example by trickling over it a developer mixture consisting of carrier particles and toner particles, by a cascade developing station 5. In a transfer station 6, the developed toner image is transferred, for example onto a paper web 7.

In cascade developing, but also, for example, in magnetic brush developing, developer mixture is conveyed from a reservoir to a point of release, from where the released developer mixture flows into a hopper and from there to the point of use by gravity or further additional aids. From the point of use, the developer mixture is returned to the stock.

Referring now especially to FIG. 1, there is shown a conveyor in which an endless belt 13 is passed around two rollers 10 and 11. Plates (or webs) 14 project from this belt 13. A considerable part of the developer mixture carried away by the webs flows back into the stock 9 in the reservoir both at the open sides of the webs and also over their edges. This flowing back is indicated in FIG. 1 by trickling-down developer particles shown as dots.

In the embodiment shown in FIG. 2, the webs 14 project almost at right angles to the belt 13. A cover sheet 12 is provided up to about the middle of the conveying height of the belt conveyor. Part of the developer mixture flows back behind the cover sheet 12, and returns directly to the stock to be combined, at a point in the reservoir where it is still flowing freely with the developer which reached the actual developing stage and was depleted in it.

FIGS. 1, 2, 3, 5, 6 and 7 also show a toner topping-up device 21 in which a roller with a longitudinal groove rotates in the bottom orifice of a toner reservoir. This groove carries toner with it out of the toner container and empties the toner into the developer mixture reservoir. The enrichment in toner advantageously takes place at a point which is passed by the part of the developer mixture which flows back directly into the developer stock. Mixing of the developer with fresh toner occurs at this stage and this enriched developer is mixed with the depleted developer. This avoids great variations in toner concentration, which can lead to objectionable non-uniformities in the copy, arising in the developer mixture which reaches the release point.

In the embodiment shown in FIG. 3, the conveyor belt 33 with the webs 14 is guided over an angled path by means of guide rollers 29 and 31. This type of arrangement gives a compact construction. Trickling-back of the developer mixture primarily takes place in the zone in which the webs on the belt are nearest to horizontal. If a wide reservoir is used, a stirrer 35 may be provided by means of which the mixing of the developer mixture which is depleted in toner with the developer mixture which is trickling back, and optionally with the toner added as replenishment, can be increased further.

FIG. 4 shows a conveyor in which the belt is not tensioned between guide rollers or drums as in the embodiment of FIG. 3. In this embodiment the conveyor belt is provided, on its inside, with teeth 25 as used in serrated belt drives. The belt 13, together with the serrations 25 and the projections 14, is made of plastic, in one piece, and preferably contains steel wires, running in the longitudinal direction, for stiffening. At the bottom, the belt is guided by a drum 10 provided with teeth 26. Stripping down of the belt is prevented by the small guide wheels 27. The belt 13 is of such stiffness that it is selfsupporting in the form shown. However, in order to obtain defined conditions and quieter running, a further guide roller 11 with teeth 26 and a support roller 29 are provided. The belt does not snap outwards at the convex point opposite the photoconductor drum 2. If complete security against this is desired, a small holding wheel or a section of guide track can also be provided additionally. In fact it has however been found that such a belt, of the shape shown, is self-supporting if it is driven by the guide roller 11.

An advantage of this embodiment is the low height and the fact that it can be manufactured particularly economically.

In the embodiment shown in FIG. 5, there is provided, in addition to the belt 13 with projections 14, parallel to the belt 13 a further belt 17 with projections 18. The direction of circulation of the belt 17 is opposite that of the belt 13 and the projections 14 and 18 intermesh in a comb-like manner in the zone between the belts. The belt 17 circulates over the rollers 19 and 20. The belt 17 conveys, by means of the webs 18, the part of the developer mixture from the developer mixture stock which does not reach the release point but trickles back into the reservoir as is indicated schematically in FIG. 5 by the tricking-down of the developer mixture from the projections 18. In this case, the two developer mixture streams are particularly clearly recognizable and their track essentially corresponds to the circulating belts 13 and 17. A certain exchange of developer mixture between the webs 14 and 18 also occurs within the zone located between the belts 17 and 13, that is to say where the projections 14 and 18 intermesh in a comb-like manner. In this zone a certain mixing of the streams also occurs.

Toner is replenished in the reservoir 8 by means of the toner replenishing device 21, in order to enrich with toner the depleted developer mixture 9.

While in the conveyor shown in FIG. 5 the free edges of the webs 14 and 18 do not touch the belts 17 and 13, respectively, they do touch in the embodiment shown in FIG. 6. Here, the webs 14 touch the belt 17 in the zone in which the webs 14 and 18 intermesh in a comb-like manner. The device shown in FIG. 6 also differs from the device shown in FIG. 5 in that the lower direction-changing roller 19 is located at a lower point than the lower direction-changing roller 10 and is of greater diameter than the upper direction-changing roller 20. The consequence of this construction of the conveying device is that the two part-streams of developer mixture are mixed even more intensely in the zone of the first intermeshing of the projections and that the toner replenishment can be carried out more precisely.

Instead of the belt 17 with projections 18 which circulates over the two rollers 19 and 20 it is also possible, for example in the embodiment shown in FIG. 6, to provide simply a drum with vanes in the position of the roller 19. This drum with vanes is appropriately located in a position in which it achieves the desired degree of mixing with the depleted developer stream.

What is claimed is:

1. Apparatus for developing an electrostatic latent image on a photoconductor with a toner enriched dry developer mixed with a depleted dry developer which has fallen back from a circulating conveyor belt into a reservoir for the developer mixture, comprising a first endless inclined conveyor belt passed around two rollers, conveyor plates positioned on said belt at intervals along its length, said plates being mounted to intercept the belt substantially at right angles to the center line thereof and projecting outwardly from the belt, said belt and plates being inclined together in a manner that after the passing of the conveyor belt through the developer reservoir a substantial portion of the developer mixture raised from the stock falls back from the conveyor plates into the reservoir, while the remaining developer mixture is raised to a receiving station, a second circulating endless conveyor belt having plates positioned parallel to the first endless conveyor belt, said plates of the second belt intermeshing with the plates of said first belt in a comb-like manner, removing a portion of the developer mixture raised from the reservoir and returning a portion to the reservoir, said belts being circulatable in opposite directions.

2. The apparatus as claimed in claim 1, wherein the first belt is integral with its plates.

3. The apparatus as claimed in claim 1, wherein the first belt has internal serrations and is driven by toothed rollers.

4. The apparatus as claimed in claim 1, wherein the plates are planar.

5. The apparatus as claimed in claim 1, wherein both of the belts and the plates are constructed of flexible material and at least the outer surface is of soft, elastic material.

6. The apparatus as claimed in claim 1, wherein both of the belts circulate around an angled track.

7. Apparatus for developing an electrostatic latent image on a photoconductor with a toner enriched dry developer mixed with a depleted dry developer which has fallen back from a circulating conveyor belt into a reservoir for the developer mixture, comprising an endless inclined conveyor belt passed around two rollers, conveyor plates positioned on said belt at intervals along its length, said plates being mounted to intercept the belt substantially at right angles to the center line thereof and projecting outwardly from the belt, said belt and plates being inclined together in a manner that after the passing of the conveyor belt through the developer reservoir a substantial portion of the developer mixture raised from the stock falls back from the conveyor plates into the reservoir, while the remaining developer mixture is raised to a receiving station, a cover plate positioned in abutting relation to a portion of the belt, which moves the particulate material from the reservoir in contact with or close to the edges of the plates remote from the belt, whereby the particulate material is returned to the reservoir only above the cover plate.

* * * * *